US007517195B2

(12) United States Patent
Caruso et al.

(10) Patent No.: US 7,517,195 B2
(45) Date of Patent: Apr. 14, 2009

(54) NESTED TURBINE BUCKET CLOSURE GROUP

(75) Inventors: David Alan Caruso, Ballston Lake, NY (US); John Cleland Lavash, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 226 days.

(21) Appl. No.: 11/380,049

(22) Filed: Apr. 25, 2006

(65) Prior Publication Data

US 2007/0248464 A1 Oct. 25, 2007

(51) Int. Cl.
*F01D 5/32* (2006.01)

(52) U.S. Cl. ..... 416/220 R; 416/222

(58) Field of Classification Search ..... 416/193 A, 416/212 A, 215, 216, 217, 218, 220 R, 222
See application file for complete search history.

(56) References Cited

U.S. PATENT DOCUMENTS 2,220,918 A * 11/1940 Smith ..... 416/191
2,844,355 A * 7/1958 Rankin ..... 416/216
4,781,532 A * 11/1988 Novacek et al. ..... 416/222
7,261,518 B2 * 8/2007 Golinkin et al. ..... 416/215
2002/0081196 A1 6/2002 Reluzco et al.
2002/0085917 A1 7/2002 Roberts et al.
2004/0081558 A1 4/2004 Munshi et al.
2004/0115052 A1 6/2004 Murphy
2004/0120817 A1 6/2004 Shapiro et al.
2004/0165989 A1 8/2004 Caruso et al.

* cited by examiner

*Primary Examiner*—Edward Look
*Assistant Examiner*—Nathaniel Wiehe
(74) *Attorney, Agent, or Firm*—Sutherland Asbill & Brennan LLP

(57) ABSTRACT

A closure bucket group for mounting on a dovetail of a turbine wheel. The closure bucket group may include a leading bucket with a leading bucket rear side, a closure bucket with a closure bucket front side and a closure bucket rear side, and a trailing bucket with a trailing bucket front side. The leading bucket rear side and the closure bucket front side define a first enclosed keyway and the closure bucket rear side and the trailing bucket front side define a second enclosed keyway. A number of keys may be positioned within the first enclosed keyway and the second enclosed keyway so as to support the closure bucket.

18 Claims, 3 Drawing Sheets

NESTED TURBINE BUCKET CLOSURE GROUP

TECHNICAL FIELD

The present application relates generally to turbines and more particularly relates to a turbine bucket closure group.

BACKGROUND OF THE INVENTION

Steam turbine airfoils or buckets are positioned around a turbine wheel at regular intervals. The buckets are assembled by inserting them one at a time axially into an opening on the wheel surface and then sliding the buckets circumferentially about the wheel. The buckets are attached by complimentary male and female dovetails. In order to close the assembly, however, the last blade must be restrained by means other than a dovetail. This last bucket, the closure bucket, generally is pinned to the wheel or affixed to its adjacent neighbors by keys.

The curved nature of the round skirt buckets, however, does not lend themselves to the use of keys in the solid portion of the skirt, i.e., the dovetail, so as to restrain the closure bucket from centrifugal forces. Axially positioned keys also are undesirable because the engagement with the adjacent buckets is very small so as to limit shear strength. Further, keys placed at an angle to the machine axis may be undesirable because the curved nature of the round skirt creates an irregular shear plane that does not intersect the center of the key at its thickest part. This may force the use of a closure block fixed to the wheel using pins. A closure block generally is a bucket without an airfoil. By removing the airfoil, the mass and centrifugal load is reduced, thereby lowering stress on the wheel pins to an acceptable level. Because the closure block has no airfoil, however, there is an opening in the steam path with detrimental effects on performance.

There is a desire therefore for an improved closure bucket that can support an airfoil without undue stress. Such a bucket should increase overall system performance.

SUMMARY OF THE INVENTION

The present application thus describes a closure bucket group for mounting on a dovetail of a turbine wheel. The closure bucket group may include a leading bucket with a leading bucket rear side, a closure bucket with a closure bucket front side and a closure bucket rear side, and a trailing bucket with a trailing bucket front side. The leading bucket rear side and the closure bucket front side define a first enclosed keyway and the closure bucket rear side and the trailing bucket front side define a second enclosed keyway. A number of keys may be positioned within the first enclosed keyway and the second enclosed keyway so as to support the closure bucket.

The leading bucket and the trailing bucket may include a pair of hooks for mating with the dovetail. The rear side of the leading bucket may include a leading bucket flat axial portion and a pair of leading bucket keyways that lie at an angle to the wheel axis along a pair of outer flat portions. The front side of the closure bucket may include a closure bucket front flat axial portion and a pair of closure bucket front keyways that lie at an angle to the wheel axis along a pair of outer flat portions. The rear side of the closure bucket may include a closure bucket rear flat axial portion and a pair of closure bucket rear keyways that lie at an angle to the wheel axis along a pair of outer flat portions. The closure bucket may include an airfoil. The front side of the trailing bucket may include a trailing bucket flat axial portion and a pair of trailing bucket keyways that lie at an angle to the wheel axis along a pair of outer flat portions. The first enclosed keyway may include a pair of first enclosed keyways and the second enclosed keyway may include a pair of second enclosed keyways The present application further describes a closure bucket group for mounting on a dovetail of a turbine wheel. The closure bucket group may include a leading bucket with a pair of leading hooks so as to mate with the dovetail, a closure bucket, and a trailing bucket with pair of trailing hooks so as to mate with the dovetail. The leading bucket and the closure bucket may define a pair of first enclosed keyways and the closure bucket and the trailing bucket may define a pair of second enclosed keyways. A number of keys may be positioned within the first enclosed keyways and the second enclosed keyways so as to support the closure bucket.

The closure bucket may include an airfoil. The leading bucket nests with the closure bucket and the trailing bucket nests with the closure bucket.

These and other features of the present application will become apparent to one of ordinary skill in the art upon review of the following detailed description of the embodiments when taken in conjunction with the drawings and the appended claims.

DETAILED DESCRIPTION

Figure 1:
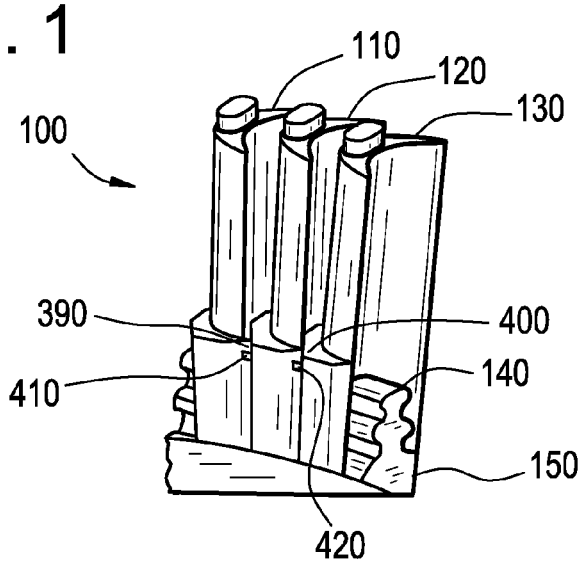
FIG. 1 is a perspective view of a closure bucket group as is described herein.
Figure 2:
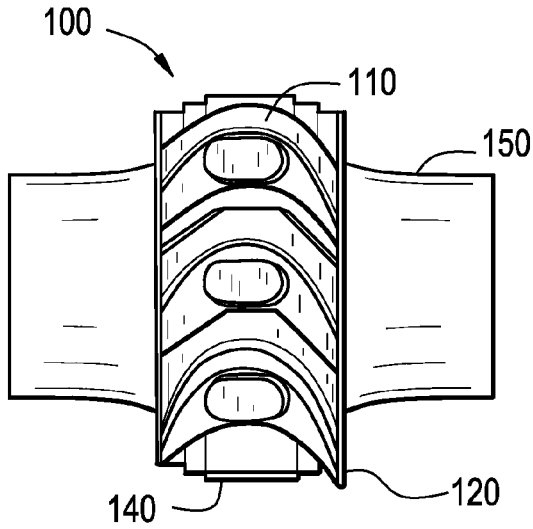
FIG. 2 is a top plan view of the closure bucket of FIG. 1.
Figure 3:
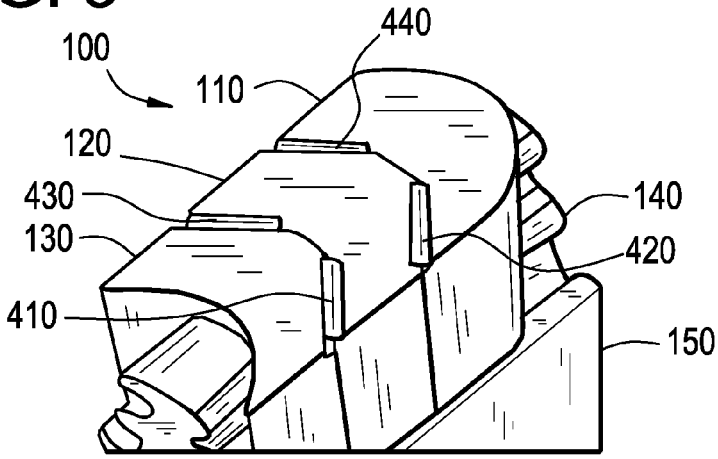
FIG. 3 is a cross-sectional view of the closure bucket group of FIG. 1.

Referring now to the drawings, in which like numerals refer to like elements throughout the several views, FIGS. 1-3 show a closure bucket group 100 as is described herein. As is shown, the closure bucket group 100 includes a leading bucket 110, a closure bucket 120, and a trailing bucket 130. The buckets 110, 120, 130 of the closure bucket group 100 are positioned on a dovetail 140 of a turbine wheel 150.

Figure 4:
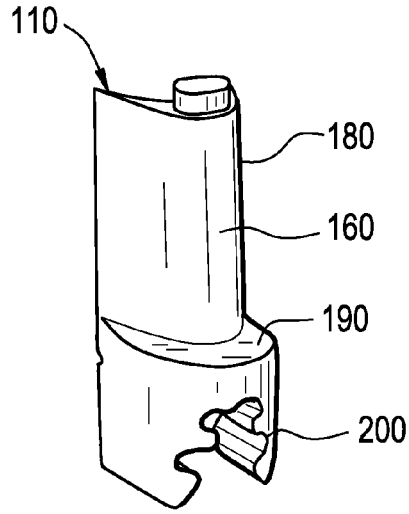
FIG. 4 is a front perspective view of a leading bucket of the closure group of FIG. 1.
Figure 5:
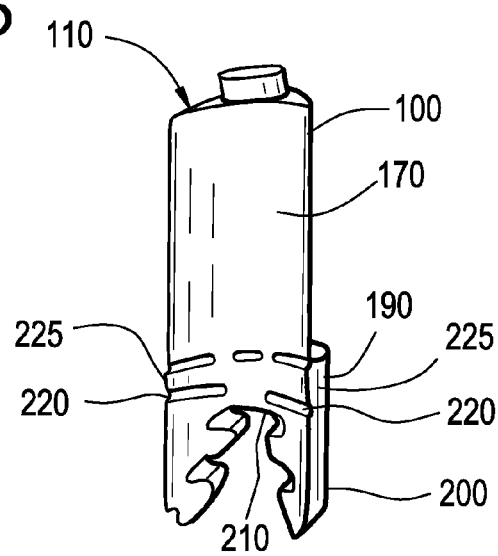
FIG. 5 is a rear perspective view of the leading bucket of the closure group of FIG. 1.

FIGS. 4 and 5 show the leading bucket 110 of the closure bucket group 100. As is shown, the leading bucket 110 has a front side 160 and a rear side 170. The leading bucket includes an airfoil 180 extending from a platform 190. The platform extends into a pair of hooks 200. The hooks 200 are sized to accommodate the dovetail 140 of the turbine wheel 150. The platform 190 on the front side 160 of the leading bucket 110 has a conventional round skirt shape. The rear side 170 has a flat axial portion 210 formed in the center of the platform 190 with two keyways 220 extending from the flat axial portion 210 to the edges of the rear side 170. The two keyways 220 lie along outer flat portions 225 at an angle to the wheel axis.

Figure 6:
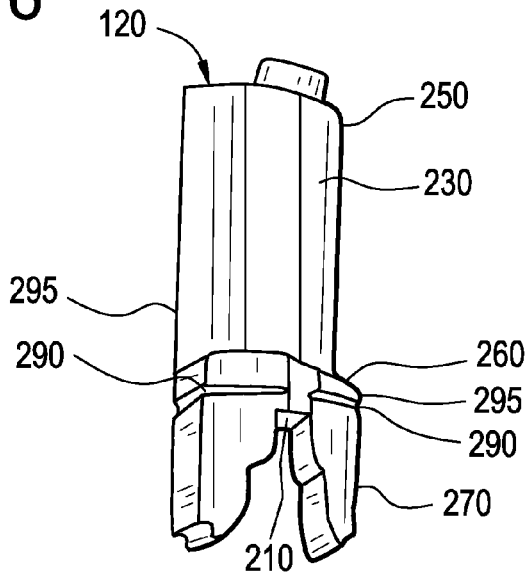
FIG. 6 is a front perspective view of the closure bucket of the closure group of FIG. 1.
Figure 7:
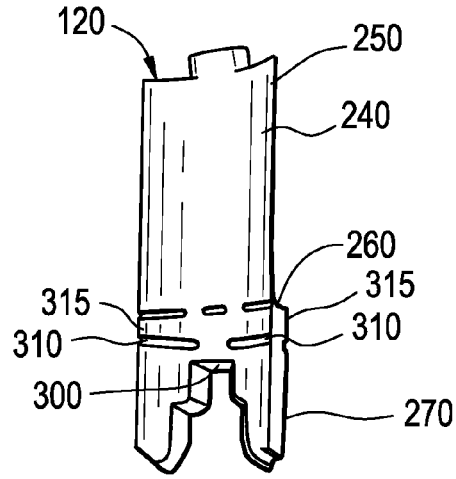
FIG. 7 is a rear perspective view of the closure bucket of the closure group of FIG. 1.

FIGS. 6 and 7 show the closure bucket 120 of the closure bucket group 100. As with the leading bucket 110, the closure bucket 120 includes a front side 230 and a rear side 240. The closure bucket 120 also includes an airfoil 250 and a platform 260. Unlike the leading bucket 110, the closure bucket 120 has a pair of legs 270 as opposed to the hooks 200. The legs 270 ride along the dovetail 140 of the turbine wheel. Instead of the rounded skirt form of the platform 190 described in the leading bucket 110, the front side 230 of the closure bucket 120 includes a flat axial portion 210 with a pair of keyways 290 extending from the flat axial portion 210 to the edges of the front side 230. The two keyways 290 lie along outer flat portions 295 at an angle to the wheel axis. The flat portions 210, 295 and the keyways 290 of the front side 230 of the closure bucket 120 can nest with the flat portions 210, 225 and the keyways 220 of the rear side 170 of the leading bucket 110. The rear side 240 of the closure bucket 120 is similar to the rear side 170 of the leading bucket 110 in that it includes a flat axial portion 300 and a pair of keyways 310 extending from the flat axial portion 300 to the edges of the rear side 240. The two keyways 310 lie along outer flat portions 315 at an angle to the wheel axis.

Figure 8:
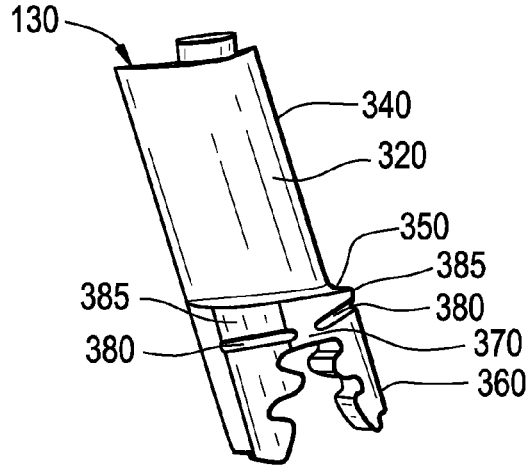
FIG. 8 is a front perspective view of the trailing bucket of the closure group of FIG. 1.
Figure 9:
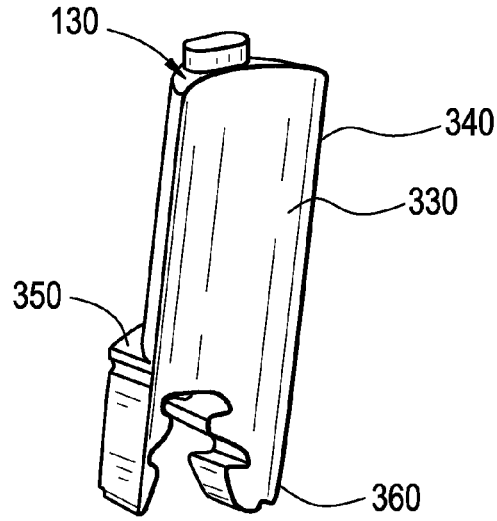
FIG. 9 is a rear perspective view of the trailing bucket of the closure group of FIG. 1.

FIGS. 8 and 9 show the trailing bucket 130 of the closure bucket group 100. The trailing bucket 130 includes a front side 320 and a rear side 330. The trailing bucket 130 also includes an airfoil 340, a platform 350, and a pair of hooks 360. The front side 320 of the trailing bucket 130 includes a flat axial portion 370 in the middle of the platform 350 with a pair of keyways 380 extending from the flat axial portion 370 to the edges of the front side 320. The two keyways 380 lie along outer flat portions 385 at an angle to the wheel axis. The flat portions 370, 385 and the keyways 380 of the front side 320 of the trailing bucket 130 can nest with the flat portions 300, 315 and the keyways 310 of the rear side 240 of the closure bucket 120. The rear side 330 of the trailing bucket 130 includes the platform 350 with the round skirt shape of a conventional bucket.

Referring again to FIGS. 1-3, when the buckets 110, 120, 130 of the closure bucket group 100 are positioned on the dovetail 140 of the turbine wheel 150, the rear side 170 of the leading bucket 110 nests with the front side 230 of the closure bucket 120. As such, the keyways 220 of the leading bucket 110 and the keyways 290 of the closure bucket 120 form a first enclosed keyway 390. Likewise, the front side 320 of the trailing bucket 130 nests with the rear side 240 of the closure bucket 120. As such, the keyway 380 of the trailing bucket 130 aligns with the keyway 310 of the closure bucket 120 so as to form a second enclose keyway 400. The keyways 390, 400 extend on both sides of the closure bucket group 100. A first key 410 may be positioned within the first enclosed keyway 390 and a second key 420 may be positioned within the second enclosed keyway 400. A reciprocal set of keys, a third key 430 and a fourth key 440, are positioned on the other side to the closure bucket group 100.

The enclosed keyways 390, 400 provide a straight shear plane along the entire length of the keys 410, 420, 430, 440. The closure bucket 120 is thus secured and supported via the keys 410, 420, 430, 440. The centrifugal load of the closure bucket 120 thus is largely transferred to the leading and trailing buckets 110, 130 via the hooks 200, 360.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A closure bucket group for mounting on a dovetail of a turbine wheel, comprising:

a leading bucket with a leading bucket rear side, the leading bucket rear side comprising a pair of leading bucket outer flat portions, each leading bucket outer flat portion forming a leading bucket angle with an axis of the turbine wheel;

a closure bucket with a closure bucket front side and a closure bucket rear side, each of the closure bucket front side and the closure bucket rear side comprising a pair of closure bucket outer flat portions, each closure bucket outer flat portion forming a closure bucket angle with the wheel axis;

a trailing bucket with a trailing bucket front side, the trailing bucket front side comprising a pair of trailing bucket outer flat portions, each trailing bucket outer flat portion forming a trailing bucket angle with the wheel axis;

wherein the leading bucket rear side and the closure bucket front side define a first enclosed keyway and wherein the closure bucket rear side and the trailing bucket front side define a second enclosed keyway; and a plurality of keys positioned within the first enclosed keyway and the second enclosed keyway.

2. The closure bucket group of claim 1, wherein the leading bucket comprises a pair of hooks for mating with the dovetail.

3. The closure bucket group of claim 1, wherein the trailing bucket comprises a pair of hooks for mating with the dovetail.

4. The closure bucket group of claim 1, wherein the rear side of the leading bucket comprises a leading bucket flat axial portion.

5. The closure bucket group of claim 1, wherein the rear side of the leading bucket comprises a pair of leading bucket keyways.

6. The closure bucket group of claim 5, wherein the pair of leading bucket keyways comprises an angle to the wheel axis along the pair of leading bucket outer flat portions.

7. The closure bucket group of claim 1, wherein the front side of the closure bucket comprises a closure bucket front flat axial portion.

8. The closure bucket group of claim 1, wherein the front side of the closure bucket comprises a pair of closure bucket front keyways.

9. The closure bucket group of claim 8, wherein the pair of closure bucket front keyways comprises an angle to the wheel axis along the pair of closure bucket outer flat portions.

10. The closure bucket group of claim 1, wherein the rear side of the closure bucket comprises a closure bucket rear flat axial portion.

11. The closure bucket group of claim 1, wherein the rear side of the closure bucket comprises a pair of closure bucket rear keyways.

12. The closure bucket group of claim 11, wherein the pair of closure bucket rear keyways comprises an angle to the wheel axis along the pair of closure bucket outer flat portions.

13. The closure bucket group of claim 1, wherein the closure bucket comprises an airfoil.

14. The closure bucket group of claim 1, wherein the front side of the trailing bucket comprises a trailing bucket flat axial portion.

15. The closure bucket group of claim 1, wherein the front side of the trailing bucket comprises a pair of trailing bucket keyways.

16. The closure bucket group of claim 15, wherein the pair of trailing bucket keyways comprises an angle to the wheel axis along the pair of trailing bucket outer flat portions.

17. The closure bucket group of claim 1, wherein the first enclosed keyway comprises a pair of first enclosed keyways and wherein the second enclosed keyway comprises a pair of second enclosed keyways.

18. A closure bucket group for mounting on a dovetail of a turbine wheel, comprising:

a leading bucket;

the leading bucket comprising a pair of leading hooks so as to mate with the dovetail;

a closure bucket;

a trailing bucket;

the trailing bucket comprising a pair of trailing hooks so as to mate with the dovetail;

the leading bucket comprising a first pair of angled surfaces shaped to mate with a second pair of angled surfaces on a front side of the closure bucket;

the trailing bucket comprising a third pair of angled surfaces shaped to mate with a fourth pair of angled surfaces on a rear side of the closure bucket;

wherein the leading bucket and the closure bucket define a pair of first enclosed keyways and wherein the closure bucket and the trailing bucket define a pair of second enclosed keyways; and a plurality of keys positioned within the pair of first enclosed keyways and the pair of second enclosed keyways so as to support the closure bucket.

* * * * *